US006078146A

United States Patent [19]

Reverberi

[11] Patent Number: 6,078,146

[45] Date of Patent: Jun. 20, 2000

[54] CENTRALIZED POWER REDUCING DEVICE, PARTICULARLY FOR LIGHTING INSTALLATIONS

[76] Inventor: Giorgio Reverberi, Via Pavoni, 5 - Castelnovo Ne' Monti, Reggio Emilia, Italy

[21] Appl. No.: 08/966,983

[22] Filed: Nov. 10, 1997

[30] Foreign Application Priority Data

May 21, 1997 [IT] Italy ..... MI97A1185

[51] Int. Cl.[7] ..... H05B 37/02

[52] U.S. Cl. ..... 315/291; 315/137; 315/361; 315/76

[58] Field of Search ..... 315/137–144, 315/361, 363, 76, 291

[56] References Cited

U.S. PATENT DOCUMENTS 4,082,981 4/1978 Morton et al. ..... 315/97
4,494,010 1/1985 Donnelly ..... 307/33
4,964,058 10/1990 Brown, Jr. ..... 364/492
5,394,064 2/1995 Ranganath et al. ..... 315/209

*Primary Examiner*—Don Wong
*Assistant Examiner*—James Clinger
*Attorney, Agent, or Firm*—Hughes Hubbard & Reed LLP; Ronald Abramson; Peter A. Sullivan

[57] ABSTRACT

Disclosed herein is a centralized power reducing device, particularly for lighting installations, comprising, on each phase of the installation power source, a winding (16) in series with load (10), wound on a magnetic core (18), the current supplied to load (10) flowing therethrough, a second winding (20) wound on said magnetic core (18), a drive or control current flowing therethrough, means (22, 24) for changing said drive or control current and wherein said means (22,24) for establishing the extent of the drive or control current in said second winding (20) are comprised of a multiple-tap autotransformer (22), the connection of said autotransformer (22) taps occurring by means of relays (24) controlled by a logic unit (26).

9 Claims, 3 Drawing Sheets

CENTRALIZED POWER REDUCING DEVICE, PARTICULARLY FOR LIGHTING INSTALLATIONS

FIELD OF THE INVENTION

The present invention relates to a centralized power reducing device, particularly for lighting installations.

BACKGROUND OF THE INVENTION

Road lighting installations, or those intended for big industrial and sporting areas involve the need of being able to change the luminous intensity as a function of the real use requirements, in order to be able to effect a remarkable saving of electric energy and lengthen the life of the lamps.

Indeed it is recognized that in public lighting installations the luminous intensity required and absolutely necessary during the first night-hours is excessive after a certain time, and if not reduced, becomes an unnecessary waste of energy. Moreover, during the same night-hours, due to the stay in producing activities, the mains voltage tends to rise above the voltage rating, thus reducing the life of the lamps.

The known systems for reducing the luminous intensity of public lighting installations are basically grounded on the use of an autotransformer for changing the voltage on the load (lamps). In the first known solution, the primary winding of the autotransformer comprises some parallel shunts by means of which, through properly connected switches, the power supplied to load is discretely changed with coarse values of the changes. The drawback of this solution is therefore that the lamps are subject to a series of stresses, jeopardizing the life thereof. The second known solution provides for continuously changing the power supplied to the lamps, however using devices with moving, wiper contact arrangements (for example, a VARIAC). Thus, they are inclined to wear, seizing and other drawbacks typical of moving parts, including the requisite of periodical controls in order to check the wear of sliding parts, inclined to wear, and the proper alignment of moving parts.

OBJECT OF THE INVENTION

Object of the present invention is to provide a power reducing device able to integrate the merits of both the mentioned arrangements, namely adapted to work in a discrete manner, but still able, by virtue of a precise calibration of the intervention steps, to progressively reduce or increase the power supplied to the lamps of a lighting installation without abrupt voltage changes, both at the initial light-on, and at the final light-off time, while keeping a simple and reliable structure, therefore having an economical construction and servicing.

SUMMARY OF THE INVENTION

To this end, the present invention provides a centralized power reducing device, particularly for lighting installations, comprising, on each phase of the installation power source, a winding in series with load, wound on a magnetic core, the current supplied to load flowing therethrough, a second winding wound on said magnetic core, a drive or control current flowing therethrough, means for changing said drive or control current, wherein said means for establishing the extent of the drive or control current in said second winding are comprised of a multiple-tap autotransformer, the connection of said autotransformer taps occurring by means of relays controlled by a logic unit.

Further advantageous characteristics of said device are recited in the annexed claims.

BRIEF DESCRIPTION OF THE DRAWINGS

The characteristics, objects and advantages of the present invention will be clearer from the following description, and the attached drawings relating to a non limiting embodiment example. Obviously, same reference number in the various Figures refer to same or equivalent parts.

The Figures show.

DESCRIPTION OF THE PREFERRED EMBODIMENT

Figure 1:
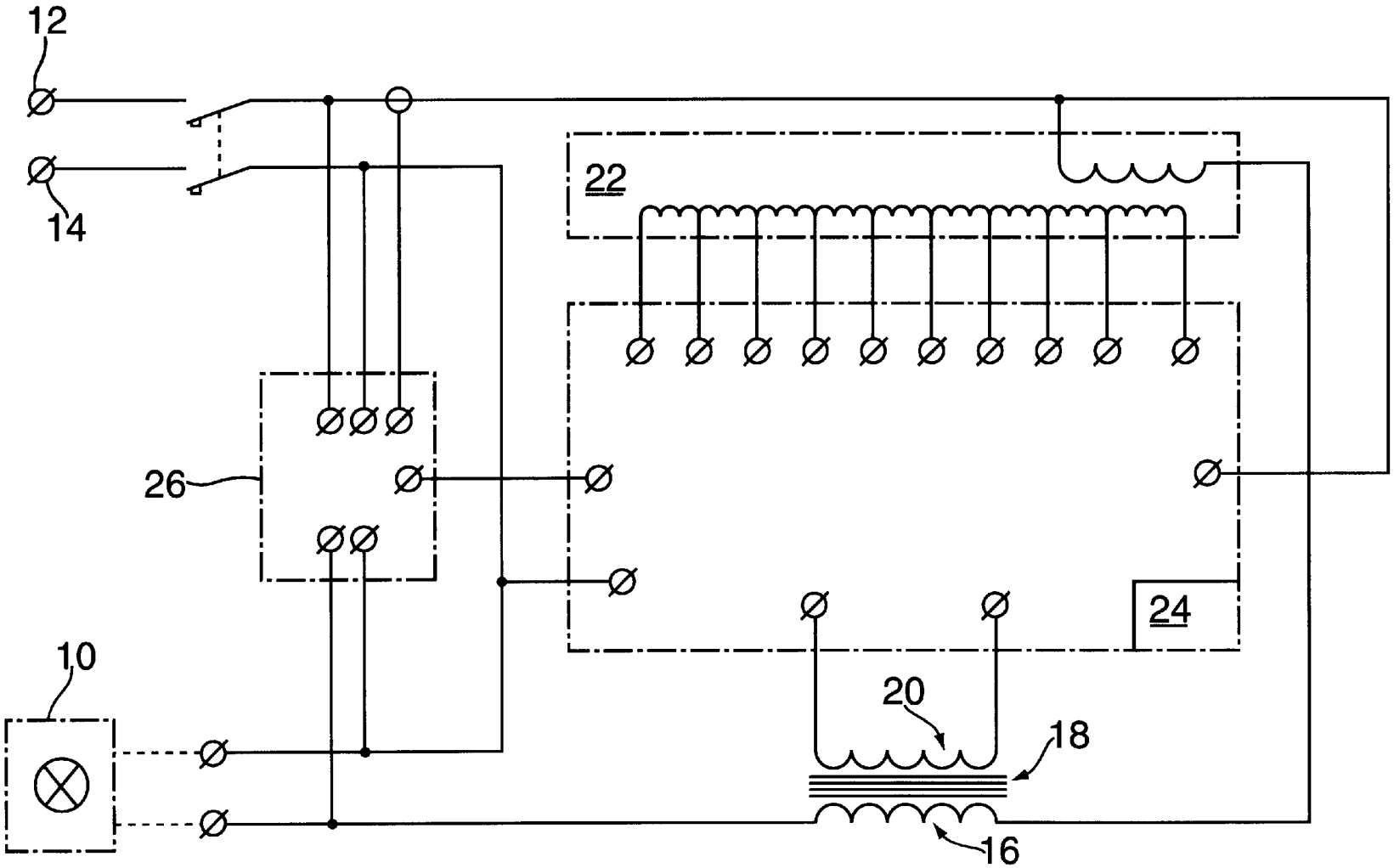
FIG. 1: a diagrammatic illustration of a lighting system with a centralized power reducing device according to the present invention being applied thereto.

With reference to FIG. 1, a lighting system is shown, modeled as a load lamp 10, fed by monophasic alternating current taken between a phase 12 of a three-phase current circuit and the neutral phase 14 thereof.

In series with load 10 there is a winding 16, which impedance affects the voltage supplied to the load. Winding 16 is wound on a magnetic core 18, a second winding or drive winding 20 being also wound thereon.

Adjustment of the power supplied to load 10 is based on adjustment of the impedance of winding 16, in turn a function of the current flowing through drive winding 20. Indeed, impedance of winding 16 will be zero when core 18 has reached magnetic saturation by means of drive winding 20, a situation arising when a determinate drive or control current is forced through said drive winding 20, just corresponding to core saturation. In this situation the voltage drop across winding 16 will be zero. For lower values of the drive or control current, down to zero, saturation of core 18 correspondingly decreases, and correspondingly the impedance of winding 16 increases, up to a maximum value to which corresponds the maximum drop of the voltage feeding the load.

According to the invention, the drive or control current is supplied to winding 20 by means of an autotransformer 22 having multiple regulation taps leading to a relay control board 24. By properly combining the opening and closing positions of the individual relays of board 24 it is possible to accomplish the change of the magnetizing current flowing through winding 20, and therefore achieve a voltage supply at load 10 less or higher than the mains rated value. It is also provided a by-pass subcircuit so that in the event of a malfunctioning of the switching relays or intervention of internal protections, the system will automatically set to by-pass position, without requiring external switching members.

In multi-phase arrangement application, not described in detail because it merely consists of applying an identical device between each phase and the neutral, the by-pass position can be reached by only one phase, while the others operate regularly according to what has been programmed in a manner which will be described later. The by-passed phase keeps in any case a fixed reduction step of 25 V in order to avoid that, even in the most unfavorable situations, the voltage will exceed the lamp rated values. Therefore the system operates in a "fail safe" logics.

A further peculiar aspect of the device according to the invention is the possibility, by virtue of the taps of autotransformer 22, of being inserted in supply arrangements having different voltage ratings, for example of 277–220–208–120 V, and frequencies of 50/60 Hz, simply by changing an internal connection.

The advantages of the device according to the invention are multiple:

digital commutation reduced dissipated power low servicing very quick response times tolerances of output voltages definable as a function of the number of the code switching elements no harmonic distortion.

Figure 3:
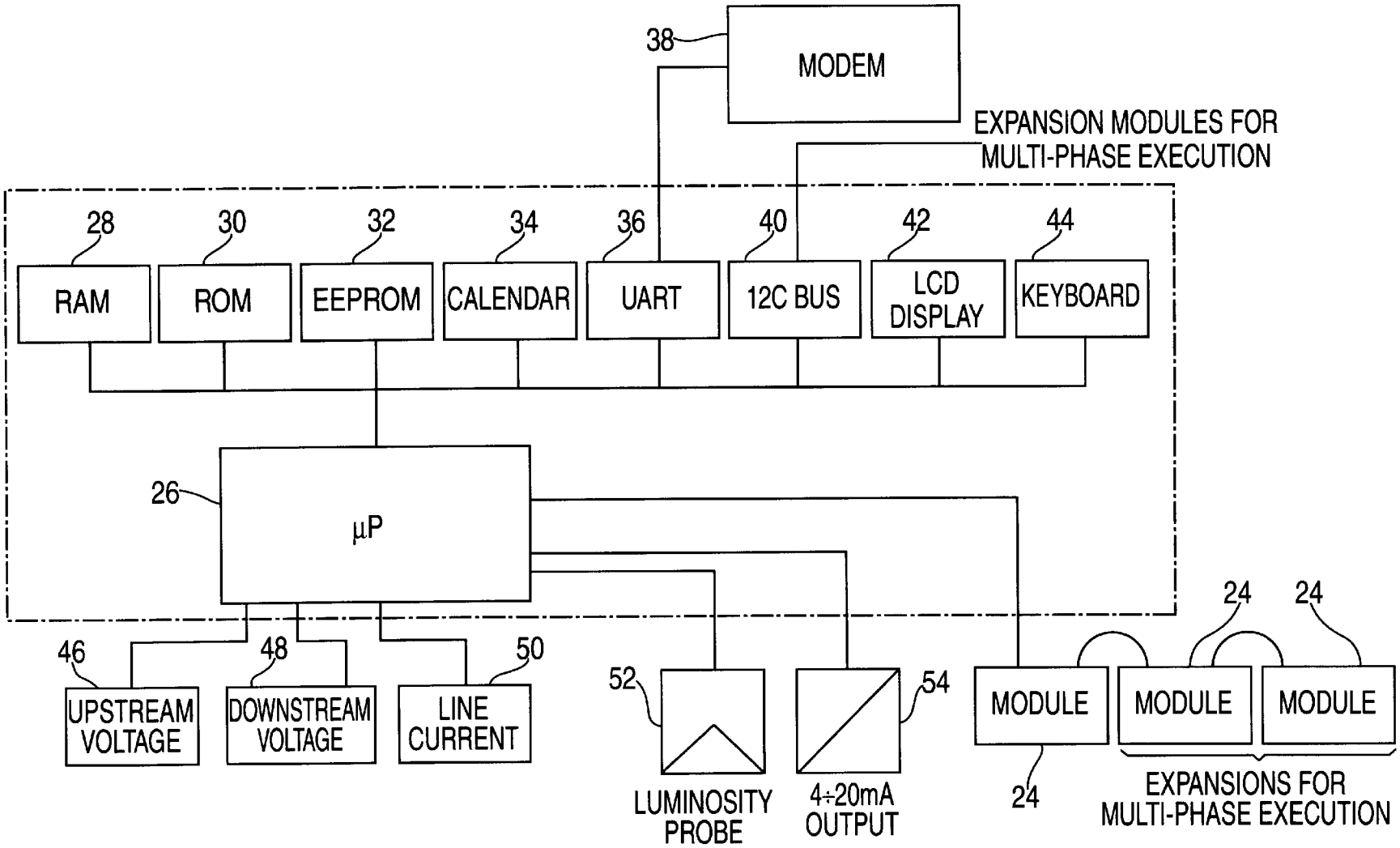
FIG. 3: a diagrammatic illustration of the control circuit of the device in FIG. 1.

The functional control of the switching relays of board 24 is carried out by a microprocessor unit 26, responsive to the external situations received by suitable signal transducers, as a luminosity probe 52 (cfr. FIG. 3), a photoelectric cell, a fog or traffic probe, etc.

Figure 2:
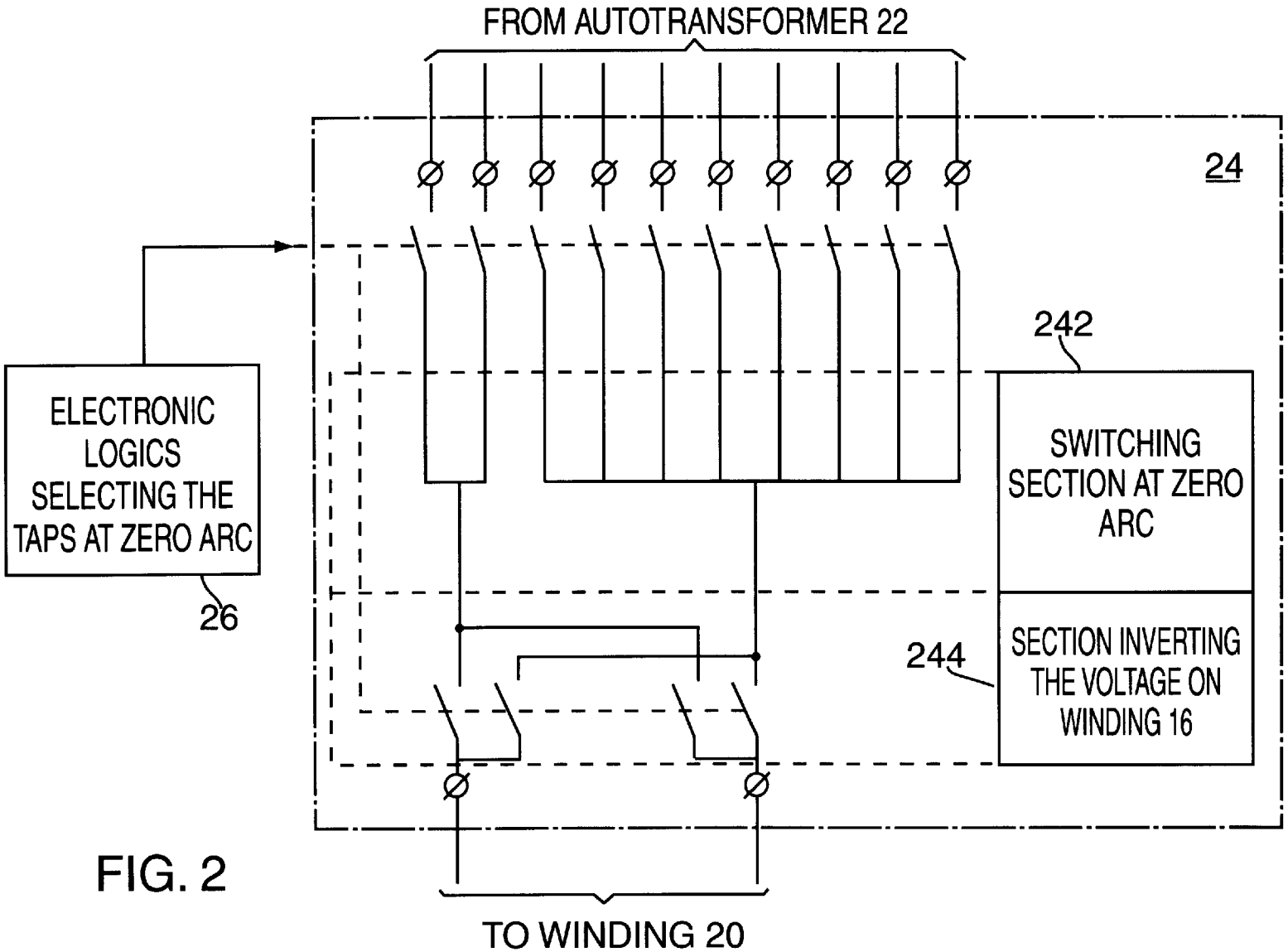
FIG. 2: a diagrammatic illustration of a relay board showed in FIG. 1.

FIG. 2 diagrammatically shows a preferred embodiment of board 24, allowing the number of autotransformer 22 taps required for covering the use field to be reduced. To this end board 24 comprises a switching section 242, advantageously working without creating any electric arc, and a section 244 adapted to invert the voltage on winding 20. Thus, the fixed 25 V voltage reduction also used for the by-pass function as mentioned above, can be added to or subtracted from the change which can be obtained by means of the autotransformer 22 taps, for example 45 V as a maximum. Consequently the operative voltage output from the regulator spans from +20 V to −70 V with respect to the input voltage.

Said microprocessor unit 26 also comprises means adapted to graduate the operation of autotransformer 22 to determine such suitable rise and descent ramps of the voltage supplied to load 10 that the latter is preserved from too abrupt voltage changes and rushes. The same means are used to keep the output voltage steady with variable input voltage.

Moreover such means as to reset the operating program of said system can be advantageously provided for, so that, in the event of current failure, it will start again from the situation relating to the first lamp switch-on, acting with due graduality whatever the transducer position might be.

The block diagram of the control part of the device according to the invention is diagrammatically illustrated in FIG. 3, where various modules are shown: microcontroller 26, a random access memory 28, a read only memory 30, and an erasable programmable memory 32, a clock/calendar 34, a communication port 36 and a modem 38, a second communication port 40, particularly for the connection to expansion modules for multi-phase execution, a display unit 42 and a data input unit 44, an analog transducer unit 52 such as a luminosity, fog, or traffic probe and the like, an analog output 54, one or more bus-connected relay boards 24, and inputs 46, 48 e 50 for the upstream voltage, downstream voltage and line current, respectively.

By means of the data input unit 44, a computer connected to communication port 36 or via modem 38, memory 28 can be programmed for custom operating cycles with respect to standard operating cycles, based on clock/calendar 34, in turn managed by microcontroller 26.

It is obvious that many changes, adaptations, integrations, variations and replacements can be made to the embodiment example described hereinbefore in an illustrative and non-limiting sense, still without departing from the scope of the invention as defined by the following annexed claims.

I claim:

1. A centralized power reducing device, particularly for lighting installations, comprising, on each phase of the installation power source:

a winding (16) in series with a load (10) for varying the voltage to said load (10), said winding wound on a magnetic core (18), said magnetic core having a magnetic field controlled by a current flowing therethrough, a second winding on said magnetic core (18) to control the current flowing through the magnetic core, a multiple-tap autotransformer (22) for controlling the current, said autotransformer being connected by means of relays (24) and being controlled by a logic unit (26).

2. The device according to claim 1, wherein said logic unit (26) controls said relays (24) in such a way that switching of the multiple taps of said autotransformer (22) occurs without generating any electric arc.

3. The device according to claim 1, wherein said logic unit (26) comprises means to graduate the operation of said switching relays (24) to obtain the desired rise or descent ramps of the voltage supplied to load (10) and maintaining it steady, within the set values, even with variable input voltage.

4. The device according to claim 1, wherein said logic unit (26) is programmable.

5. The device according to claim 1, wherein said logic unit (26) receives signals from external transducers, such as a luminosity probe (52), a fog probe or a traffic probe and controls said relays (24) thereby.

6. The device according to claim 1, further comprising a subcircuit by-passing autotransformer (22), adapted to be inserted by said logic unit (26).

7. The device according to claim 1, wherein the switching taps of said autotransformer (22) are movable, the device being connectable with electric distribution arrangements having different voltage ratings.

8. The device according to claim 1, wherein the relays (24) comprise a section (244) adapted to invert the output voltage of said autotransformer (22) before adding it to a fixed reduction of the input voltage, the voltage across winding (20) thereby changing with respect to the device input voltage in a range spanning from a reduction equal to the sum of said fixed reduction and the maximum output voltage of autotransformer (22) taken as negative, to an increase equal to the difference between the maximum output voltage of said autotransformer (22) taken as positive and said fixed reduction.

9. The device according to claim 6, wherein the relays (24) comprise a section (244) adapted to invert the output voltage of said autotransformer (22) before adding it to a fixed reduction of the input voltage, the voltage across winding (20) thereby changing with respect to the device input voltage in a range spanning from a reduction equal to the sum of said fixed reduction and the maximum output voltage of autotransformer (22) taken as negative, to an increase equal to the difference between the maximum output voltage of said autotransformer (22) taken as positive and said fixed reduction, said fixed voltage reduction being generated by said by-pass subcircuit.

* * * * *